US005509199A

United States Patent [19]

Beamer et al.

[11] Patent Number: 5,509,199

[45] Date of Patent: Apr. 23, 1996

[54] METHOD OF MAKING A DUAL RADIATOR AND CONDENSER ASSEMBLY

[75] Inventors: Henry E. Beamer, Middleport; Prasad S. Kadle, East Amherst; Richard P. Ryan, East Amherst, all of N.Y.; John P. Papin, Gasperich, Luxembourg

[73] Assignee: General Motors Corporation, Detroit, Mich.

[21] Appl. No.: 373,702

[22] Filed: Jan. 17, 1995

[51] Int. Cl.[6] ..... B23P 15/00

[52] U.S. Cl. ..... 29/890.07; 29/890.03

[58] Field of Search ..... 165/140, 135, 165/173, 144, 149; 29/890.07, 890.03, 890.031

[56] References Cited

U.S. PATENT DOCUMENTS

| | | | |
|---|---|---|---|
| 5,000,257 | 3/1991 | Shinmura | 165/140 |
| 5,009,262 | 4/1991 | Halstead et al. | 165/140 |
| 5,033,540 | 7/1991 | Tategami et al. | 165/135 |
| 5,107,926 | 4/1992 | Calleson | 165/173 |
| 5,163,507 | 11/1992 | Joshi | 165/135 |
| 5,186,243 | 2/1993 | Halstead | 165/135 |
| 5,186,246 | 2/1993 | Halstead | 165/140 |
| 5,289,873 | 3/1994 | Ryan et al. | 165/149 |
| 5,348,081 | 9/1994 | Halstead et al. | 165/144 |

*Primary Examiner*—Irene Cuda
*Attorney, Agent, or Firm*—Patrick M. Griffin

[57] ABSTRACT

An automotive dual radiator and condenser assembly with optimized structural and thermal capabilities. The two halves or layers of the dual assembly are interconnected by a pair of widely spaced, narrow webs, which webs interconnect two halves of a slotted tandem header plate unit. The webs, though small, are sufficient to maintain all components of the whole assembly properly and rigidly spaced at all times, during assembly, during brazing, and during and after installation. The two webs also represent the only significant direct heat conduction path between the radiator and condenser, so that thermal efficiency is comparable to a pair of non connected units.

3 Claims, 6 Drawing Sheets

METHOD OF MAKING A DUAL RADIATOR AND CONDENSER ASSEMBLY

This invention relates to automotive dual radiator and condenser assemblies in general, and specifically to such an assembly with a structure that both eases assembly and improves thermal performance.

BACKGROUND OF THE INVENTION

Most automotive vehicles with an air conditioning system have a condenser mounted in front of an engine cooling radiator. The two heat exchangers operate independently, but both are exposed to the same fan assisted cooling air stream pulled through the vehicle grill. The radiator works at much higher temperatures than the condenser, so the fact that the cooling air stream flows over the condenser first does not significantly affect the operation of the radiator. Conductive heat flow in the reverse direction, from radiator to condenser, would be highly detrimental, however, and has to be avoided. Since there is usually no direct structural interconnection between the two, direct heat conduction from radiator to condenser is generally not a problem.

The need for part reduction to shorten vehicle assembly time has led to the consolidation of vehicle components wherever possible. Because of their physical proximity and similarity in size and orientation, many attempts have been made, on paper at least, to integrate the condenser and radiator into a dual assembly that can be handled and installed as a unit. These attempts have failed to adequately take into account the realities of the manufacturing process, as well as structural and thermal performance in the vehicle. A brief review of the growing number of patents in this area shows designs the practical shortcomings of which are only now beginning to come to light.

Two early designs focused on one component, the corrugated cooling fins that are brazed between the adjacent pairs of parallel liquid tubes, and which are critical to transferring heat out of the fluid tubes and into the cooling air stream. In each design, the cooling fins represent the only significant common component between the radiator and condenser portions of the dual assembly. U.S. Pat. No. 5,000,257 discloses a dual assembly with two separate pairs of parallel tanks and two separate arrays of tubes extending between the tanks. The common structural connections between the two arrays of tubes consist first of a pair of reinforcing side plates, although no details of exactly how the reinforcements connect to the tanks are disclosed. Secondly, the corrugated cooling fins that serve the two arrays of tubes are common, extending across the central plane of the entire assembly. This arrangement is made possible by the fact that the tubes in the two arrays are equally spaced, and so arranged in coplanar pairs. The theory, apparently, was that while common side plates alone would have been enough to retain the condenser and radiator together as one unit, without the common cooling fins there would have been so little component commonality as to render the integration effort not worthwhile. The great drawback of common cooling fins serving both the radiator and condenser is that they represent a very effective, direct heat conduction path from one to the other, which severely effects thermal performance and efficiency. Consequently, a punched out, relieved area at the center of the cooling fin is provided to ostensibly reduce conductive cross flow. While such an approach would limit conductivity, it would not eliminate it, and would also make the fin much more difficult to manufacture.

Another similar design follows almost the same approach, but relies on the common corrugated cooling fins as literally the only structural interconnection between the radiator and condenser portions of the dual assembly. As seen in U.S. Pat. No. 5,033,540, the fins are also cut through almost completely at the center by a conduction reducing relief. However, this design could be impractical if not impossible to manufacture by conventional techniques. Heat exchangers typically lay flat on conveyer belts as they run through braze ovens, where they are heated to a very high temperature, a temperature high enough to melt and soften metal. This would especially effect metal cut down to a thin section. The central fin cut out shown in the '540 design is so severe that the upper half of the unit would almost surely sag down into the lower half in the oven. Secondly, even if the assembly could be properly supported in the braze oven, when it was installed in the vehicle, both portions of the unit would have to be securely and independently mounted onto the vehicle body. The common fins are so weakened at the center that they would not survive road vibration forces if only one portion of the dual assembly were secured to the vehicle body.

Another series of related and evolving designs, assigned to the assignee of the subject invention, are structurally robust and simple from a manufacturing standpoint, and have a high degree of structural unitization. But they have not been optimized in terms of thermal performance. U.S. Pat. No. 5,009,262, the earliest design, had a very high degree of structural commonality. In fact, essentially every paired component and part that could be integrated into one part was so combined, including combining the four tanks into a one pair of bifurcated, extruded tank units, with a central, integral dividing wall. Tubes and fins were also combined. Unfortunately, this also provided a maximum amount of direct heat conductive path between the radiator and condenser portions of the dual assembly, especially through the common tank divider walls and common fins. Later evolutions of the design attempted to reduce the conductive heat flow without really departing from the basic design. In U.S. Pat. No. 5,163,507, an enclosed conduction reducing slot was coextruded in the tank dividing wall. In U.S. Pat. No. 5,186,243, an open, slightly more effective conduction reducing slot is shown in the tank divider wall. In U.S. Pat. No. 5,186,244, the common tubes are thinned in the middle and notched, using an approach similar to what was done to the tank wall in the '243 patent. In U.S. Pat. No. 5,186,246, the tank is not a completely integral extrusion, but instead has a separate stamped and slotted header plate, which is crimped down onto a central dividing wall of an open extrusion to enclose it. A tank with a separate header plate is much more manufacturable than a completely integral extrusion. The design shown has just as much direct conductive flow path between the two halves of the tank as the integral extruded tank, however.

In conclusion, there is still a need for a dual condenser and radiator assembly in which the constituent components are relatively simple to manufacture and assemble, and at least commonized, if not integrated, and in which the interconnection between the condenser and radiator portions of the assembly is structurally sufficient, but not so great as to significantly impair thermal performance.

SUMMARY OF THE INVENTION

The invention provides a dual assembly in which the constituent components are commonized where possible, though still structurally separate for the most part. The direct structural interconnection between the two portions of the dual assembly is minimized and optimized so as to provide sufficient strength, but not impair thermal efficiency.

In the embodiment disclosed, the four tanks necessary for the radiator and condenser halves of the dual assembly are each fabricated from four structurally separate, open sided tank units, similar in cross section. Pairs of the tank units are enclosed by tandem header plates to create side by side, dual tanks. The tank units are trough shaped, with full length deformable flanges that are continuous but for a pair of identical, discrete notches. The tandem header plate units that enclose the tank units consist of a pair of identical slotted header plates that are maintained in a closely spaced, parallel orientation by a pair of discrete webs. The webs fit into the corresponding tank unit flange slots, which are crimped over the edges of the header plates. The webs constitute the sole physical connection between the two halves of each dual tank. Between the two dual tanks is a central core, which consists of two evenly spaced arrays of structurally separate tubes, which fit into the slotted header plates, and corrugated cooling fins, which fit closely between the pairs of adjacent tubes. A pair of side plates borders and reinforces both sides of the core.

There are two alternative embodiments for the cooling fins and side plates, which allow two different cores to be built up by two different, but similar, methods. In both embodiments, the cooling fins for each half of the core are structurally separate, as are the tubes, though essentially identical in size and shape. This increases the number of components, but reduces the conductive heat cross flow. When the core is built up, the first layer of tubes and fins are dropped in place in a stacking table, then the second layer is added. In one embodiment, the cooling fins are wide enough to touch at the central plane of the core. While the fins do contact, their points of contact are only where the corrugations cross, which is minimal. In an alternative embodiment, the fins are narrower, and do not contact at the core's central plane.

Once either embodiment of the central core has been stacked, the dual tanks are inserted onto each side of the core over the exposed tube ends. The webs in the tandem header plate units maintain the proper header plate and slot spacing during tank insertion. Then, the entire assembly is laid flat and run through a conventional braze oven. During brazing, the same webs maintain the two layers of the assembly spaced apart, without sagging. During and after installation to the vehicle body, the webs are strong enough to continue to hold the two halves of the assembly together as an integral unit. During operation of the vehicle, the webs represent the only direct conduction path between the two halves, apart from the minimal cooling fin contact in the one embodiment. So, thermal efficiency is not significantly effected. In conclusion, a dual radiator and condenser assembly is provided which is truly practical to manufacture, assemble, install and operate.

DESCRIPTION OF THE PREFERRED EMBODIMENT

These and other features of the invention will appear from the following written description and drawings, in which.

Figure 2:
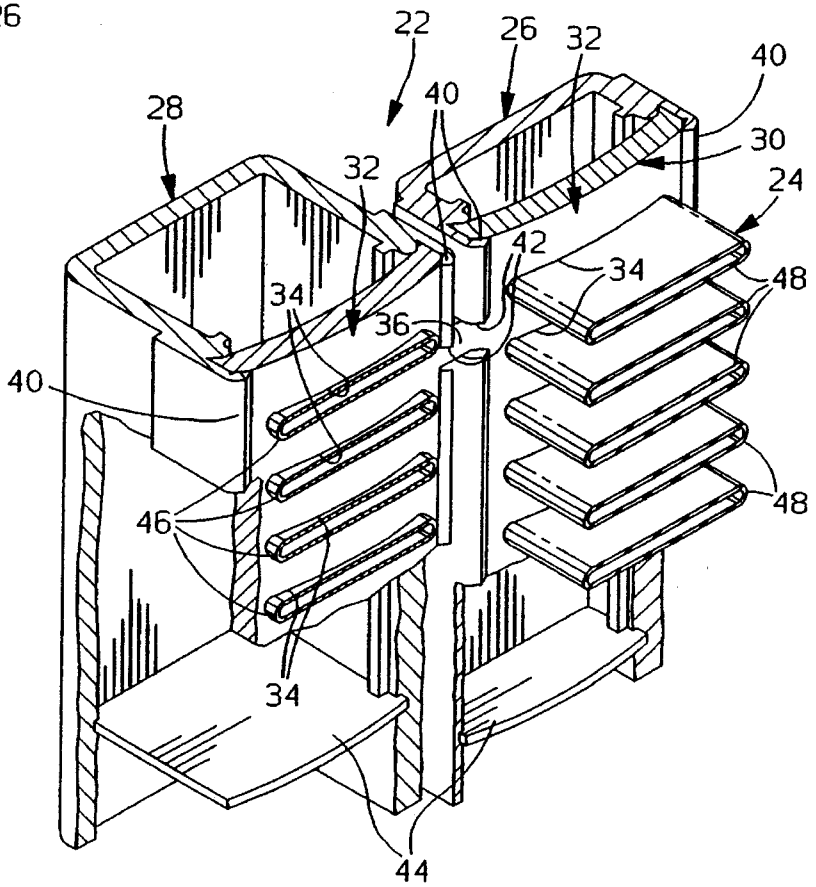
FIG. 2 is a perspective view of a portion of a dual tank broken away to reveal internal structure.
Figure 1:
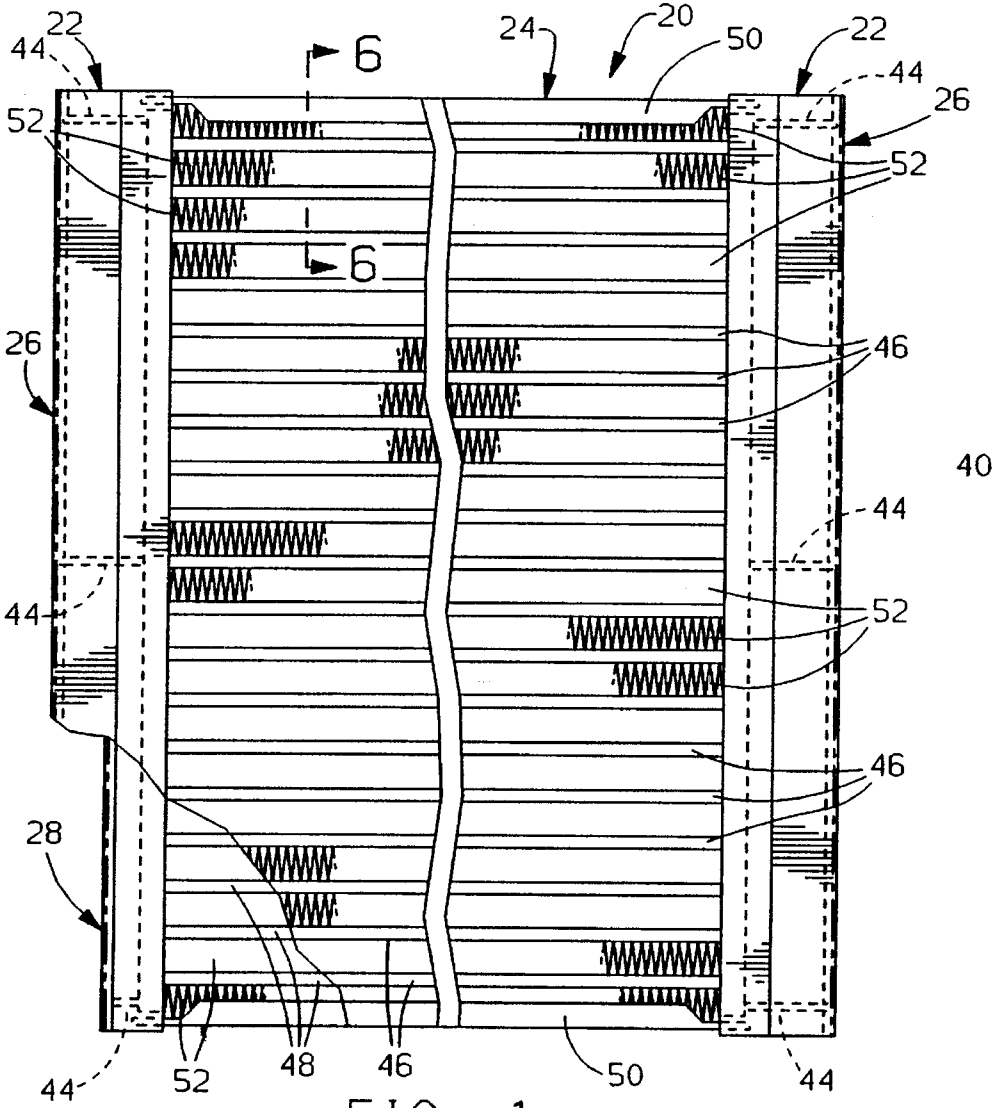
FIG. 1 is a front view of a completed dual assembly.

Referring first to FIGS. 1 and 2, a preferred embodiment of the dual radiator and condenser assembly of the invention, indicated generally at 20, consists basically of two dual tanks, indicated generally at 22, and a central core, indicated generally at 24. The tanks 22 and core 24 are built up independently, then combined before the entire dual assembly 20 is brazed solid. Details of the tanks 22 are described first.

Figure 3:
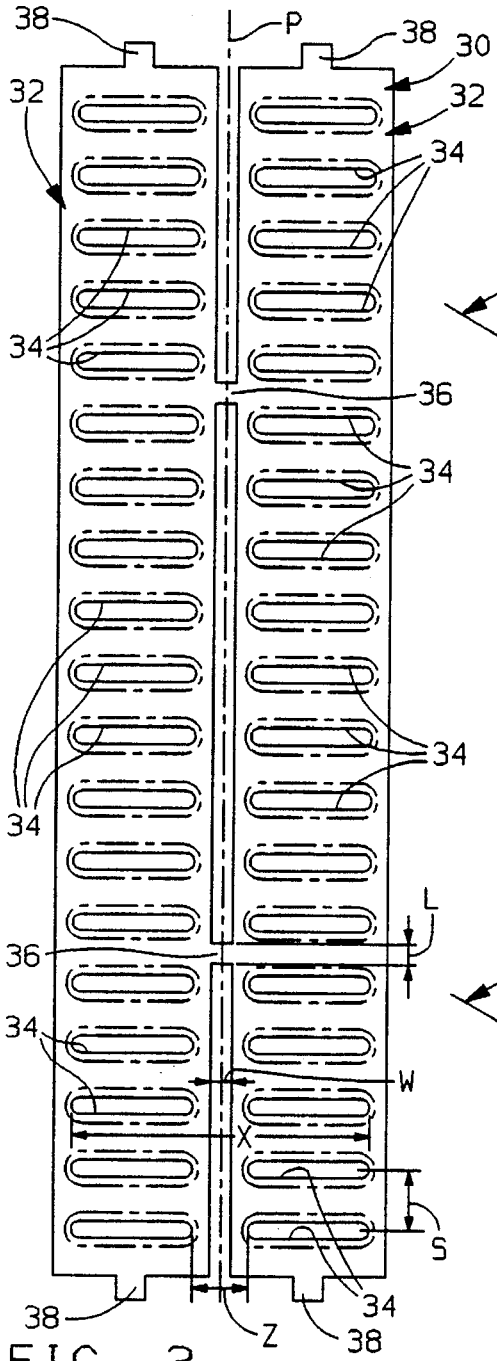
FIG. 3 is a plan view of a tandem header plate unit alone.

Referring next to FIGS. 2 and 3, each dual tank 22 is comprised of three basic parts, a pair of trough shaped tank units, including a condenser tank unit 26 and radiator tank unit 28, and a tandem header plate unit 30. The header plate unit 30 is stamped integrally from a sheet of aluminum clad with suitable braze material, just as conventional, single sided header plates are. Each tandem header plate unit 30 includes two identical, parallel edged, header plates 32, each of which has a slight curvature seen in cross section. Each plate 32 has a series of tube slots 34 regularly spaced at S. The slots 34, within each header plate 32, serve to locate the liquid tubes, described below, in adjacent, parallel pairs, with the same spacing S. The two plates 32 themselves are maintained in a parallel, closely spaced relationship, symmetrical to either side of a central plate P, by, and only by, a pair of widely longitudinally separated, discrete webs 36. Each web 36 has a width W and length L. W is small, on the order of four mm, and L is a very small percentage of the total length of the header plates 30, on the order of five percent or less. Each web 36 is as thick as the stock from which unit 30 is stamped, of course. While the only structural interconnection between the two plates 32 is the webs 36, these are more than strong enough to maintain the plates 32 in the spatial relationship shown, and will resist normal handling forces during assembly without bending. It should be noted that, given their wide longitudinal spacing, the two webs 36 together would resist any forces attempting to compress the two header plates 32 together and bring their inner edges into contact. The webs 36 serve to maintain the regular slots 34 in the two side by side header plates 32 in coplanar pairs, keeping the greatest edge to edge spacing between corresponding slot pairs 34 at X, indicated in FIG. 3, and the least edge to edge spacing at Z. Finally, narrow, centrally located tabs 38 at the end of each header plate 32 interlock with a part of the core 24 described below.

Figure 17:
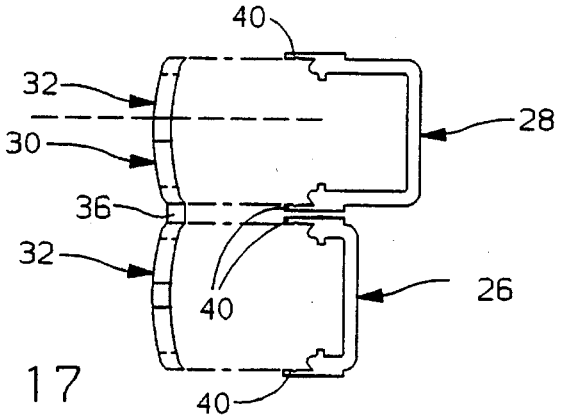
FIG. 17 is a view of the end of the tank units and tandem header plate unit being assembled to produce one of the two dual tanks.

Referring next to FIGS. 2 and 17, each tank unit 26 and 28 is identical, except that the radiator tank unit 28 is larger in cross section and volume. Each is a structurally separate, unclad aluminum piece extruded continuously as an elongated, open sided trough or box. Coplanar edges of the trough are comprised of a pair of parallel, deformable flanges 40, which are separated by the edge to edge width of either header plate 32. The flanges 40 are continuous except for a pair of discrete notches 42, which match the header plate webs 36 in size and location. The notches 42, since they represent localized discontinuities, would have to be cut after the tank units 26 and 28 were extruded. As illustrated in FIG. 17, a dual tank 22 is produced by inserting the webs 36 into the notches 42, which automatically locates and aligns the edges of the header plates 32 properly between the flanges 40 of the two tank units 26 and 28. Then, the flanges 40 are crimped in and down over the edges of the header plates 32. Before the header plate unit 30 is added, conventional inserts 44 are inserted in corresponding pockets in the tank units 26 and 28, to provide tank end caps and also to define multiple flow passes, if desired.

Figure 4:
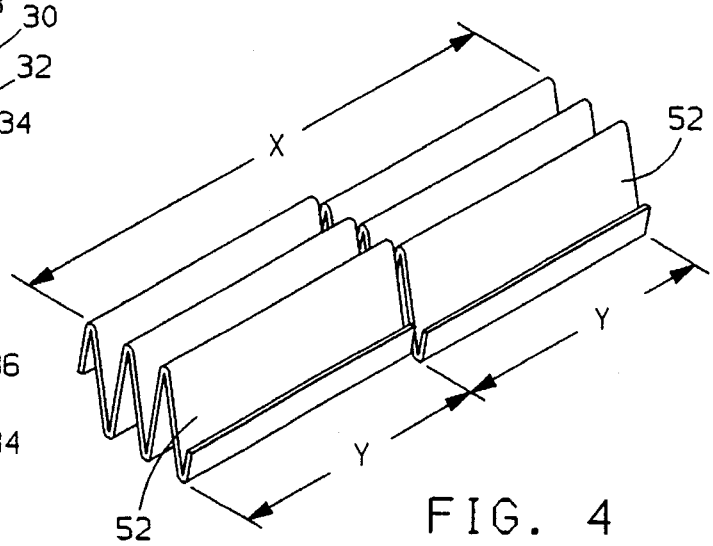
FIG. 4 is a perspective view of a portion of one embodiment of the cooling fins.
Figure 6:
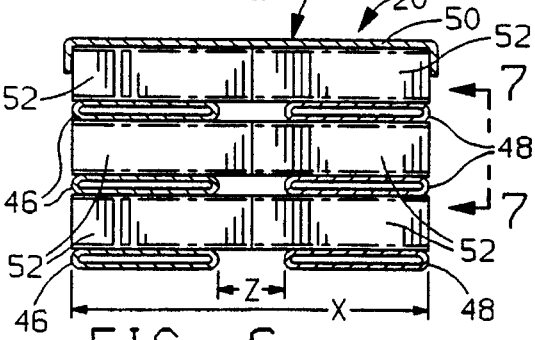
FIG. 6 is a sectional view taken along the line 6—6 of FIG. 1.

Referring next to FIGS. 4 and 6, the individual components that make up core 24 are illustrated. As noted above, while the components are largely structurally separate, and therefore more numerous than in other designs, they are similar, if not identical, for both the condenser and radiator portions of the core 24, so that their manufacture is really no more difficult than for single designs. Core 24 includes a number of radiator tubes 46, an equal plurality of condenser tubes 48, a pair of reinforcing side plates 50, and a plurality of pairs of corrugated cooling fins 52. The tubes 46 and 48 are disclosed as being identical, with equal width and thickness, which is convenient, although they need not be. They could also be produced by different methods. The radiator tubes 46 could be formed as a folded and welded tube, with the condenser tubes 48 being continuously extruded. All that is critical to the invention is that they be structurally separate, and sized so that their ends, at least, fit within the header plate slots 34. The reinforcing side plates 50 are also conventional, being stamped aluminum channels with a width equal to the depth of the core 24. The cooling fins 52 are all identical, and have the same thickness, since the tubes 46 and 48 have the same spacing, and are sized to fit closely, peak to peak, between adjacent pairs of both the tubes 46 and 48. The fins 52 also have the same nominal corrugation pitch, and a width Y that is half of the greatest edge to edge slot spacing X. This width is sufficient to allow the fins 52 to self locate when the core 24 is stacked, as is described below. The fins 52 are also completely conventional in construction, and no special tooling would be required to roll form them from a braze clad aluminum stock.

Figure 8:
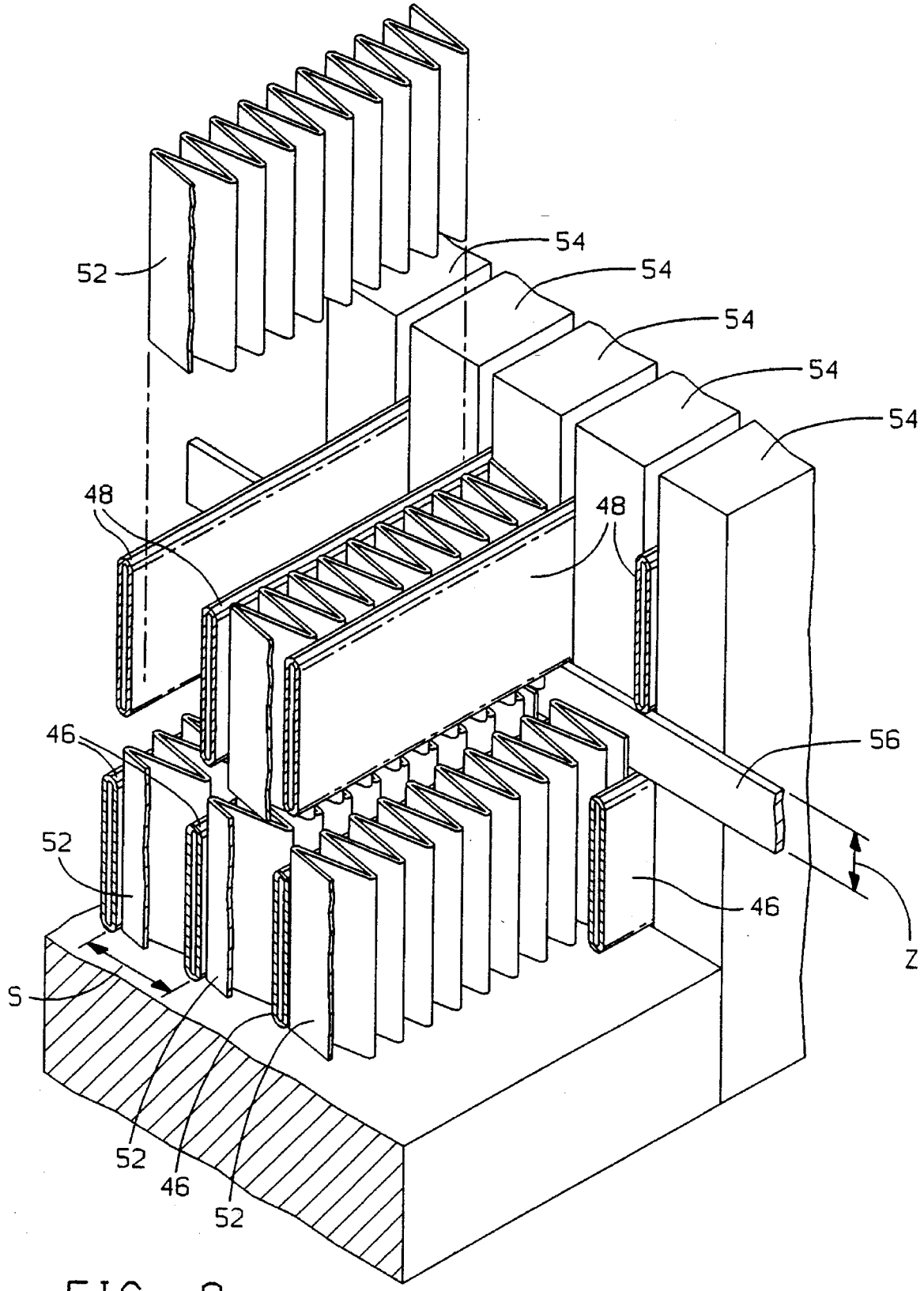
FIG. 8 is a perspective schematic view of an apparatus used to build up the central core.
Figure 9:
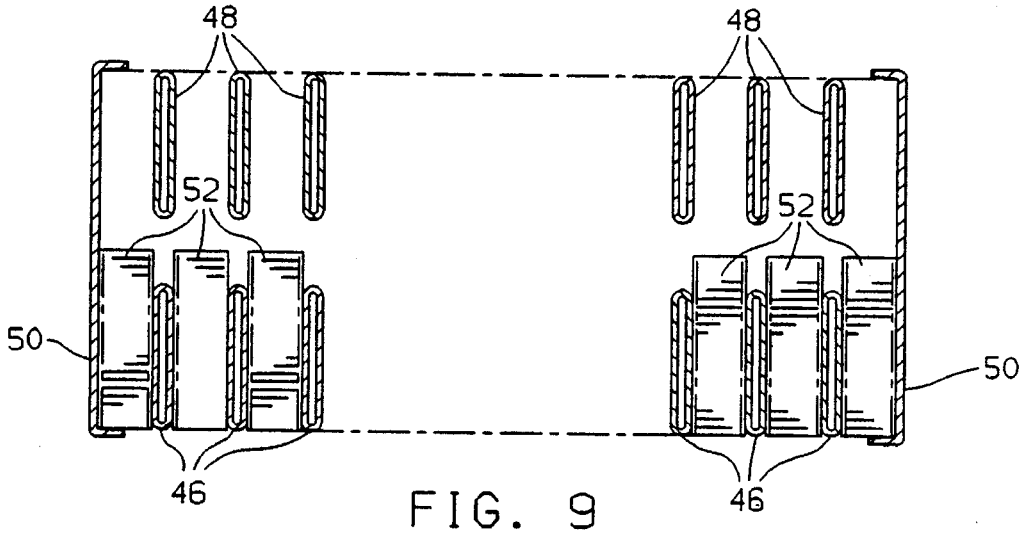
FIG. 9 is a schematic view illustrating an early stage in the assembly process of one embodiment of the central core.
Figure 10:
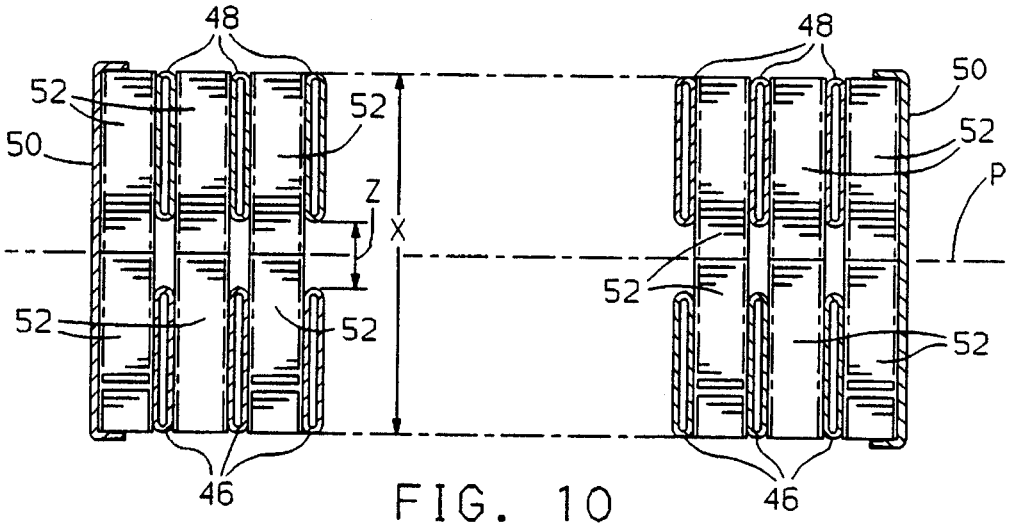
FIG. 10 shows the next step in the assembly process.

Referring next to FIGS. 8 through 10, the process by which core 24 is stacked is illustrated. A stacking table includes a plurality of tube spacing blocks 54, which are typical apart from being deep enough to accommodate two layers of tubes 46 and 48. The spacing blocks 54 assure a regular tube spacing, farther apart when the tubes 46 and 48 are first dropped in place, and narrower as the core 24 is finished and squeezed together to be strapped for transport to the braze oven. This is done to allow the fins 52 to be inserted between adjacent tube pairs with less resistance. Those skilled in the art will recognize that, in the drawing figures, the blocks 54 are shown as maintaining the ends of the tubes 46 and 48 spaced apart by the final spacing S, which built into the header plate slots 34. This is a closer spacing than would actually be used as the core 24 was being stacked, and is done in order to consistently illustrate the fully assembled spatial relationships between the various components of the core 24. As shown in FIG. 8, a first layer of tubes, either the radiator tubes 46 or condenser tubes 48, (46 here) is dropped in place between the blocks 54, along with a pair of side plates 50. Which layer of tubes 46 or 48 is dropped in place first is arbitrary. Then, a cooling fin 52 is dropped between each pair of adjacent tubes 46 (or 48), either manually or automatically depending on the apparatus used. The outermost two fins 52 are located between a side plate 50 and adjacent tube 46. The first layer of fins 52 hits and rests on a flat table surface that is flush with the tubes 46, thereby aligning their lower ends flush with the tubes 46, and locating their upper (or inner) ends at the central plane P noted above. Next, a thin tube spacer slat 56 is lain across the first layer of tubes 46 and up against the spacing blocks 54. Slat 56 is clear of the fins 52, meaning that it is thin enough not to overlay the ends of the cooling fins 52, and also has a width Z equal to the least edge to edge spacing of the header plate slots 34 referred to above. A tube spacing mechanism could also be built integrally into the blocks 54, if desired. Then, the second layer of tubes 48 (or 46) is dropped into the blocks 54, the ends of which hit the slat 56 so as to keep them temporarily spaced from the first layer by the distance Z, as shown in FIG. 9. As shown in FIG. 10, the second layer of cooling fins 52 is then dropped into place between each adjacent pair of tubes 48. The width Y of the cooling fins 52 described above is designed so that the second layer of fins 52 is self locating. Their lower (or inner) ends hit and rest on the upper ends of the first assembled layer of fins 52, thereby automatically aligning and registering them with the second layer of tubes 48, just as a common, single cooling fin extending all the way across both tubes 46 and 48 would do. The heat conduction problem created by common cooling fins does not occur, however, as is described in more detail below.

Figure 7:
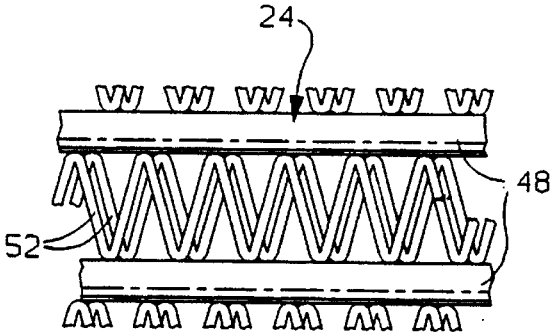
FIG. 7 is a view of FIG. 6 taken along the line 7—7 of FIG. 6.
Figure 18:
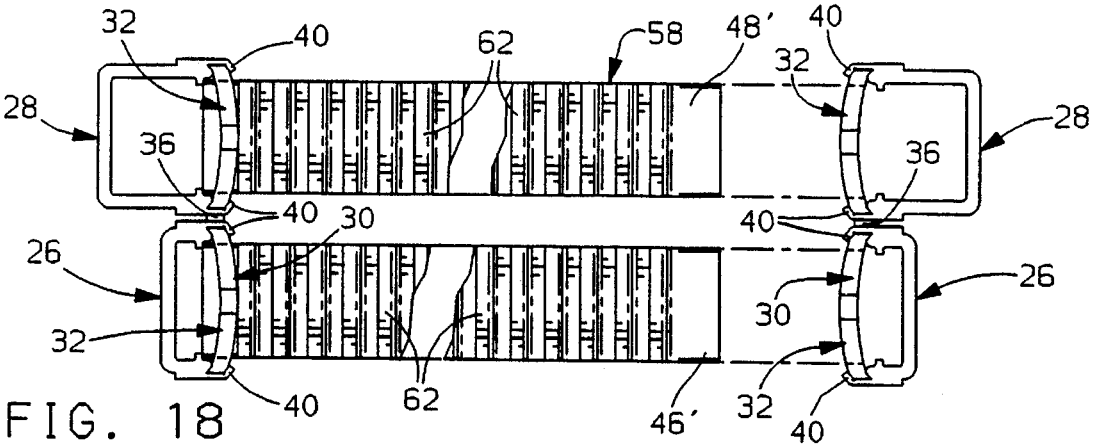
FIG. 18 is a view showing the completed tanks being assembled onto the central core.

Referring next to FIGS. 6 and 7, and to FIG. 18, the completion of the dual assembly 20 is illustrated. With all tubes 46, 48 and fins 52 in place, the blocks 54 are moved closer together, compressing the peaks of the cooling fins 52 between the adjacent pairs of tubes 46 and 48, and regularly spacing the ends of the tubes 46 and 48 so as to exactly match the two rows of header plate slots 34, in terms of the above noted dimensions X, Y and S. The side plates 50 would then be tied together by steel straps or otherwise to maintain the whole core 24 together temporarily. The spacing slats 56 can be removed at this point, or at any point before the core 24 is brazed, since the compressive forces hold the components of core 24 in place and properly spaced. Then, as shown in FIG. 18, the core 24 is moved to another station (or, the spacing blocks 54 are just moved out of the way) and the header plate slots 34 of the tanks 22 are pushed over the exposed ends of the tubes 46 and 48. The header plate webs 36 maintain the two rows of slots 34 in sufficiently accurate alignment to assure successful insertion over the ends of the tubes 46 and 48. FIG. 18 actually shows an alternate embodiment 58 of the core, described in detail below, but the tanks 22 and their installation thereto are the same. As the tank 22 is pushed in place, the header plate tabs 38 interlock with slotted ends of the side plates 50 as illustrated in co assigned U.S. Pat. No. 5,289,873, which is herein incorporated by reference. The frictional fit of the ends of the tubes 46 and 48 within the header plate slots 34 is enough to hold the tanks 22 onto the strapped core 24 as the entire dual assembly 20 is run through a conventional braze oven. This would most likely be done with the assembly 20 laying flat on a conveyor belt, in the FIG. 18 orientation. During the brazing process, the surface of those components clad with a braze material, such as the header plate unit 30 and fins 52, melts and runs. Braze seams form by capillary action at the various component interfaces. During the brazing process, the webs 36 are robust enough to maintain the two header plates 32 in their closely spaced, parallel relation. The fins 52, while they touch at the central plane P as noted above, would not actually have a large area of contact. The probability that the corrugations of a cooling fin 52 located between a pair of condenser tubes 48 would align exactly, peak to peak, with the corrugations of the fin 52 located between an adjacent pair of radiator tubes 46 is not significant. This is especially true since the corrugations within a given fin 52 do not maintain an absolutely regular pitch, in practice, nor need they. Instead, the abutted fins 52 will take on a relative orientation more like that shown in FIG. 7, though not as regular, criss-crossing and intersecting at small, discrete points. Even if braze connections form at these intersection points, they will be minimal in area.

Figure 5:
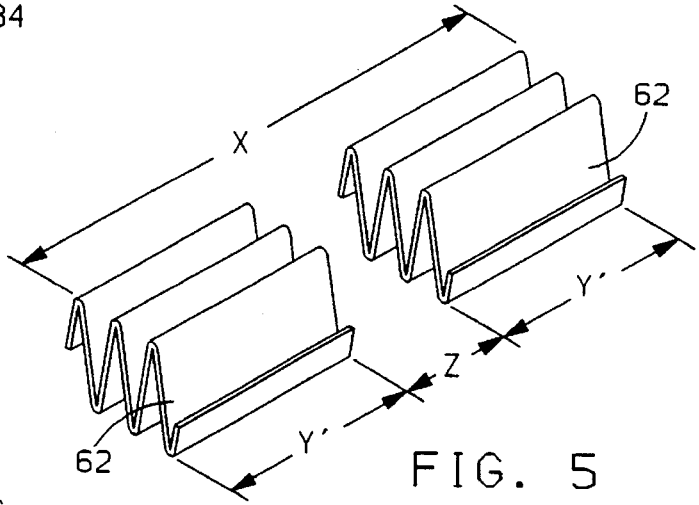
FIG. 5 is a perspective view of an alternative embodiment of the cooling fins.
Figure 11:
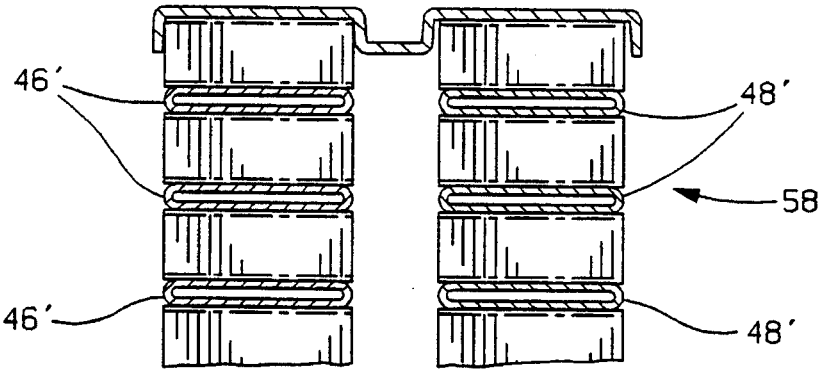
FIG. 11 shows a cross section like FIG. 6, but of an alternative embodiment of the core.
Figure 12:
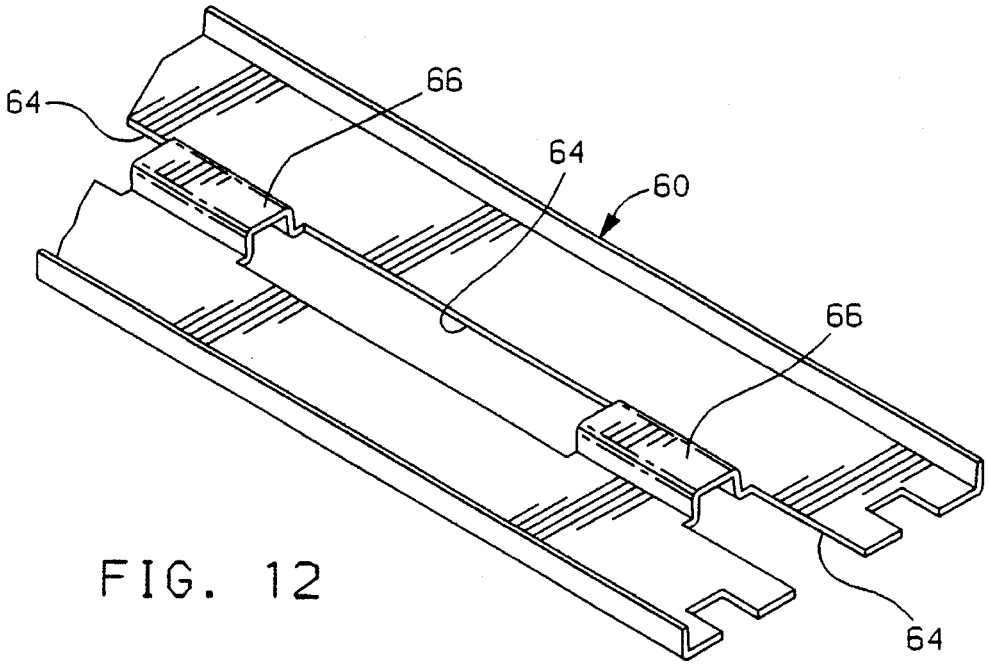
FIG. 12 is a perspective view of the core reinforcing side plate used in the alternate embodiment.

Referring next to FIGS. 5 and 11, the alternative embodiment of the core 58 referred to above is illustrated. Core 58 is the same size as core 24, and fits together with the same tanks 22. It also uses the same tubes, numbered 46' and 48', and would be assembled on the same basic stacking apparatus as core 24. The differing components are the side plates, indicated generally at 60, and the cooling fins 62. The side plates 60 are the same size and material as side plates 50, but are relieved along their central length by several slots 64, and strengthened by intermediate channels 66, which compensate for the material removed by the slots 64. The slots 64 have a width equal to the quantity Z discussed above. The cooling fins 62 are identical to the cooling fins 52, but have a smaller width Y', which is roughly equal to the width of a corresponding tube 46' or 48'. Stated differently, the width Y' is equal to one half of the quantity X minus Z. Consequently, as shown in FIG. 11, when the fins 62 are aligned with the tubes 46' and 48', they are spaced apart at their inner ends by the distance Z, with no contact. This fin spacing is provided in part by the side plates 60 and the way they are incorporated in the core assembly process, described next.

Figure 13:
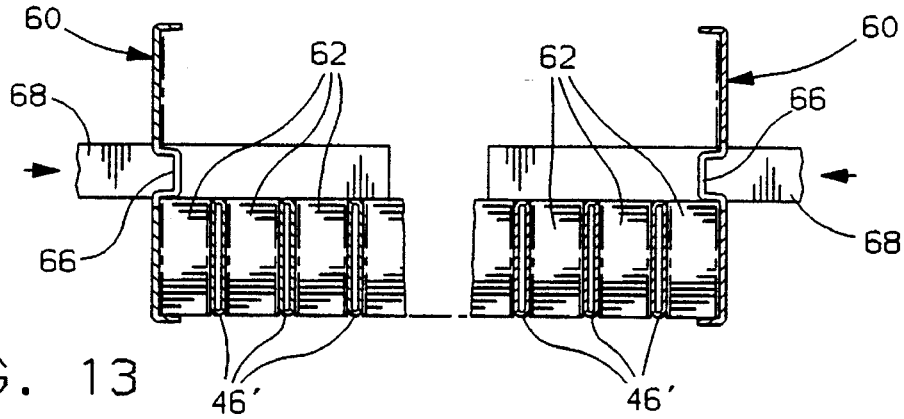
FIG. 13 is a view like FIG. 9, but showing the second core embodiment being built up.
Figure 14:
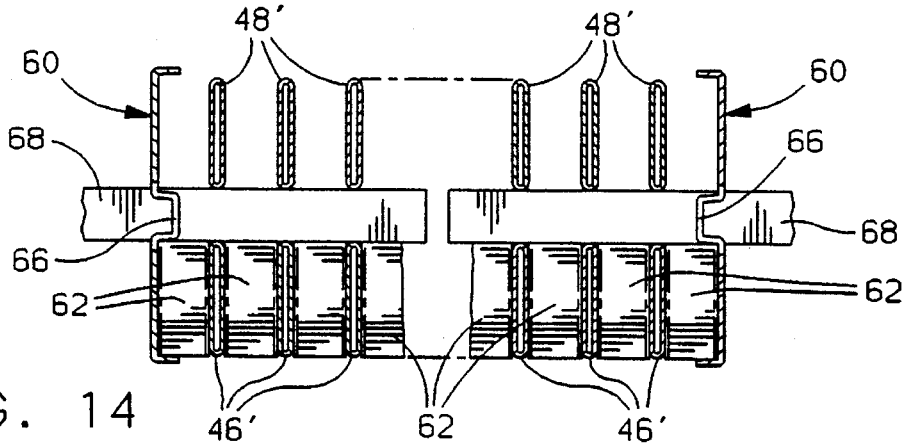
FIG. 14 is a view of the FIG. 13 assembly step slightly later in time.
Figure 15:
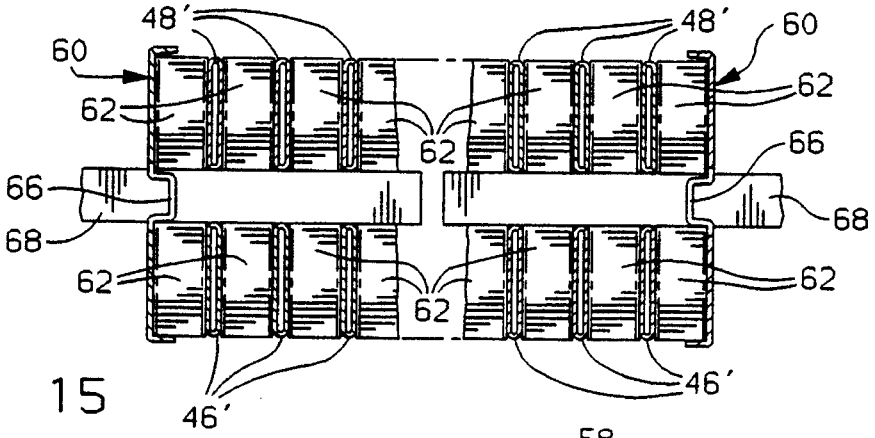
FIG. 15 is a view of the next step in the assembly process.
Figure 16:
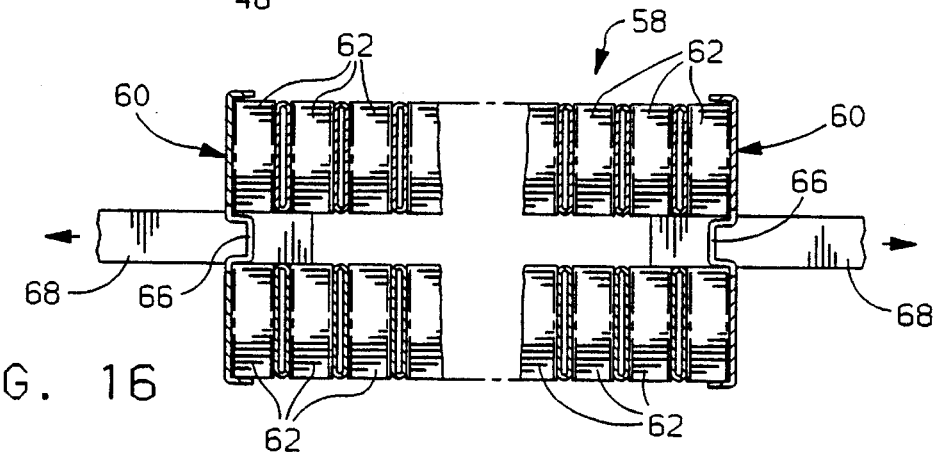
FIG. 16 is a view of the assembly process step following FIG. 15.

Referring to FIGS. 13 through 16, using the same stacking table as for core 24, a first layer of tubes 46' (or 48') is dropped in place, with cooling fins 62 between. Then, spacing slats 68, sized to fit closely, but freely, through the slots 64 are pushed laterally through the side plate 60 in each direction, as shown in FIG. 13, until they nearly abut end to end. Unlike the narrower spacing slats 56 used with core 24, the slats 68 deliberately overlay and cover a good deal of the surface area of the first layer of tubes 46' and fins 62, like slats across a bed frame. Next, as shown in FIGS. 14 and 15, the second layer of tubes 48' and cooling fins 62 is dropped in place, the edges of which rest on the slats 68, and are thereby maintained apart by the spacing Z. Then, as shown in FIG. 17, the core 58 would be strapped around the side plates 60 (by straps that corresponded in location with the channels 66) and the slats 68 withdrawn. As with core 24, the same tanks 22 would be added and the same braze operation carried out.

With either embodiment of the central core, 24 or 58, the radiator and condenser portions of the dual assembly 20 are retained structurally together by the webs 36 with sufficient strength that the assembly 20 can be shipped, handled and installed to the vehicle as an integral unit. Either side of the dual tank 22, meaning either tank unit 26 or 28, could be bracketed to the vehicle body alone and still provide sufficient support for the entire assembly 20. The webs 36 are loaded in shear along the central plane P noted, but are so short that they are effectively very stiff and resistant to deformation. There is less total integration of components than with earlier dual assemblies, since the tubes and fins are not common to the radiator and condenser portions of the assembly 20, and the tank units 26 and 28 are initially separate. While this involves more component handling when the core 24 (or 58) is stacked, it is worthwhile, since the only conductive paths between the radiator and condenser portions of the assembly 20 are the webs 36, and, in the case of core 24, the intersection points between the abutting inner end edges of the cooling fins 52. The webs 36 occupy such a small percentage of the total length of the header plates 32 that the degree of heat conduction between the two halves of the tanks 22 is not significant. Older designs discussed above are often conductively connected along the entire length of the tanks. Furthermore, even with core 24, the additional conductive contact between the abutted, criss crossed fins 52 is not nearly as significant as when the fins are common across both portions of the dual assembly. Assembly 20, therefore, represents a clear optimization in terms of part commonality, as balanced against installation ease and thermal operational efficiency.

Variations in the embodiments disclosed could be made. In both cores 24 and 58, the radiator tubes 46 and condenser tubes 48 are shown as having the same spacing S. However, since the cooling fins 52 and 62 are both structurally separate and independently installed, the tube spacing could be altered, simply by altering the regular spacing in the header plate slots 34. Two independently acting rows of tube spacer blocks would be necessary in the stacking apparatus, however, unless the two different tube spacings were exact multiples of one another. It would be possible, at least with the first embodiment of core 24, to build the central plane spacing Z into the spacing blocks themselves and eliminate the temporary spacer 56, since the fins 52 locate themselves. More than two discrete webs 36 could be used to join the two header plates 32 together, although such would not likely be necessary, since two points adequately determine a line. This would also entail cutting more matching slots in the tank unit flanges 40. The core reinforcing side plates 50 or 60 could be removed in favor of a pair of dead tubes 46 and 48 at the outboard sides of the core, thereby simplifying the design somewhat. Reinforcing side plates are typically used in a core, however, and present a much stronger banding surface when the core is strapped for the braze oven. Therefore, it will be understood that it is not intended to limit the invention to just the embodiment disclosed.

The embodiments of the invention in which an exclusive property or privilege is claimed are defined as follows:

1. A method of manufacturing and assembling a vehicle dual radiator and condenser assembly having minimal structural and heat conductive interconnection, comprising, providing a pair of identical tandem header plate units, each tandem unit having a pair of elongated, parallel edged, regularly slotted header plates, one corresponding to said radiator and one to said condenser, and maintained in side by side, parallel relation by a pair of discrete, longitudinally separated webs occupying a small percentage of the total length of said header plates, providing four structurally separate, generally trough shaped tank units, one pair corresponding to said radiator and one pair corresponding to said condenser, each tank unit having an open side defined by a pair of parallel edges that are spaced apart by substantially the width of a respective one of said header plates, said edges being continuous along their length but for a pair of spaced apart, discrete notches matching said header plate unit webs, providing a plurality of radiator tubes to fit into the slots in one of said header plates, providing a plurality of condenser tubes structurally separate from said radiator tubes to fit into the slots in the other of said header plates, providing a plurality of corrugated cooling fins to fit between adjacent pairs of said radiator tubes, providing a plurality of corrugated cooling fins to fit between adjacent pairs of said condenser tubes which are structurally separate from said radiator cooling fins, placing said header plate webs into said notches to locate said header plates between said tank unit edge and then joining said tank edge to the edges of said header plates to produce two dual tanks, stacking said radiator and condenser tubes and respective cooling fins into a central core with a tube end spacing matching said header plate slot spacing, installing each of said dual tanks to said central core by inserting said header plate slots simultaneously over said radiator and condenser tube ends, and brazing said dual tanks and central core together to create said dual radiator and condenser assembly, the radiator and condenser portions of which are retained together by said discrete webs, thereby reducing conductive heat cross flow.

2. A method of manufacturing and assembling a vehicle dual radiator and condenser assembly having minimal structural and heat conductive interconnection, comprising, providing a pair of identical tandem header plate units, each tandem unit having a pair of elongated, parallel edged, regularly slotted header plates, one corresponding to said radiator and one to said condenser, and maintained in parallel relation on either side of a central plane by a pair of discrete, longitudinally separated webs occupying a small percentage of the total length of said header plates, thereby maintaining said header plate slots in coplanar pairs with a predetermined greatest edge to edge slot spacing and a predetermined least edge to edge slot spacing, providing four structurally separate, generally trough shaped tank units, one pair corresponding to said radiator and one pair corresponding to said condenser, each tank unit having an open side defined by a pair of parallel deformable flanges that are spaced apart by substantially the width of a respective one of said header plates, said flanges being continuous along their length but for a pair of spaced apart, discrete notches matching said header plate unit webs, providing a plurality of radiator tubes to fit into the slots in one of said header plates, providing a plurality of condenser tubes structurally separate from said radiator tubes to fit into the slots in the other of said header plates, providing a plurality of corrugated cooling fins to fit between adjacent pairs of said radiator tubes having a width substantially equal to one half of said greatest edge to edge slot spacing, providing a plurality of corrugated cooling fins to fit between adjacent pairs of said condenser tubes and also having a width substantially equal to one half of said greatest edge to edge slot spacing, placing said header plate webs into said notches to locate said header plates between said tank unit flanges and deforming said flanges over the edges of said header plates to produce two dual tanks, stacking one of said plurality of radiator or condenser tubes in a first tube layer with a tube spacing equal to said header slot spacing and with said cooling fins aligned with said tubes, inserting a temporary spacer having a width equal to said least edge to edge slot spacing across said first layer tube ends at a location clear of said cooing fins, stacking the other of said plurality of radiator or condenser tubes in a second tube layer spaced from said first layer by said temporary spacer and also with a tube spacing equal to said header slot spacing, inserting cooling fins between adjacent tubes of said second layer until they abut the cooling fins of said first tube layer, thereby aligning said cooling fins with said second tube layer and completing said central core, tying said central core and removing said temporary spacers, installing each of said dual tanks to said central core by inserting said header plate slots simultaneously over said radiator and condenser tube ends, and brazing said dual tanks and central core together to create said dual radiator and condenser assembly, the radiator and condenser portions of which are retained together by said discrete webs, thereby reducing conductive heat cross flow.

3. A method of manufacturing and assembling a vehicle dual radiator and condenser assembly having minimal structural and heat conductive interconnection, comprising, providing a pair of identical tandem header plate units, each tandem unit having a pair of elongated, regularly slotted header plates, one corresponding to said radiator and one to said condenser, and maintained in parallel relation on either side of a central plane by a pair of discrete, longitudinally separated webs occupying a small percentage of the total length of said header plates, thereby maintaining said header plate slots in coplanar pairs with a predetermined greatest edge to edge slot spacing and a predetermined least edge to edge slot spacing, providing four structurally separate, generally trough shaped tank units, one pair corresponding to said radiator and one pair corresponding to said condenser, each tank unit having an open side defined by a pair of parallel deformable flanges that are spaced apart by substantially the width of a respective one of said header plates, said flanges being continuous along their length but for a pair of spaced apart, discrete notches matching said header plate unit webs, providing a plurality of radiator tubes to fit into the slots in one of said header plates, providing a plurality of condenser tubes structurally separate from said radiator tubes to fit into the slots in the other of said header plates, providing a plurality of corrugated cooling fins to fit between adjacent pairs of said radiator tubes having a width substantially equal to said radiator tubes, providing a plurality of corrugated cooling fins to fit between adjacent pairs of said condenser tubes having a width substantially equal to said condenser tubes, placing said header plate webs into said notches to locate said header plates between said tank unit flanges and deforming said flanges over the edges of said header plates to produce two dual tanks, stacking one of said plurality of radiator or condenser tubes in a first tube layer with a tube spacing equal to said header slot spacing and with said cooling fins aligned with said tubes, inserting temporary spacers having a width equal to said least edge to edge slot spacing laterally across said first layer tubes, stacking the other of said plurality of radiator or condenser tubes in a second tube layer spaced from said first layer by said temporary spacer and also with a tube spacing equal to said header slot spacing, inserting cooling fins between adjacent tubes of said second layer until they abut said temporary spacers to complete said central core, tying said central core together and removing said temporary spacers, installing each of said dual tanks to said central core by inserting said header plate slots simultaneously over said radiator and condenser tube ends, and brazing said dual tanks and central core together to create said dual radiator and condenser assembly, the radiator and condenser portions of which are retained together only by said discrete webs, thereby reducing conductive heat cross flow.

* * * * *